US005123639A

United States Patent [19]

Edwards

[11] Patent Number: 5,123,639

[45] Date of Patent: Jun. 23, 1992

[54] STANDARD AND REVERSE COLLATOR USING A REMOVABLE IDLER ROLLER SHAFT

[75] Inventor: Robert J. Edwards, Ridgefield, Conn.

[73] Assignee: Pitney Bowes Inc., Stamford, Conn.

[21] Appl. No.: 739,636

[22] Filed: Aug. 2, 1991

[51] Int. Cl.[5] ..... B65H 31/08

[52] U.S. Cl. ..... 271/212; 271/198

[58] Field of Search ..... 271/198, 207, 212, 220

[56] References Cited

U.S. PATENT DOCUMENTS

| | | | |
|---|---|---|---|
| 4,502,805 | 3/1985 | Humbs | 271/212 |
| 4,640,506 | 2/1987 | Luperti et al. | 271/212 |
| 4,805,891 | 2/1989 | Luperti et al. | 271/220 |
| 4,925,180 | 5/1990 | Golicz | 271/198 |
| 5,083,769 | 1/1992 | Young, Jr. | 271/198 |

FOREIGN PATENT DOCUMENTS

| | | | |
|---|---|---|---|
| 977953 | 12/1964 | United Kingdom | 271/212 |

*Primary Examiner*—Robert P. Olszewski
*Assistant Examiner*—Steven M. Reiss
*Attorney, Agent, or Firm*—Charles R. Malandra, Jr.; David E. Pitchenik; Melvin J. Scolnick

[57] ABSTRACT

In a reversible collating machine for stacking sheets of paper fed seriatim thereto from a singulating feeder in the same or reverse order as the sheets appear in the singulating feeder, the collating machine comprising a plurality of upper and lower belts suspended over a plurality of pulleys, each of the belts having an upper and lower reach wherein the lower reach of the upper belts and the upper reach of the lower belts frictionally engage and transport the sheets of paper, a plurality of upper ramp guide blocks secured to a frame, wherein each of the upper ramp guide blocks includes at least two idler rollers for defining a path for the upper belts, an improvement comprises a removable idler roller shaft having rotatably mounted thereto one of the idler rollers for each of the upper ramp guide blocks, wherein each of the upper ramp guide blocks has a first slot in which the idler roller shaft rests and a second slot perpendicular to the first slot in which the one idler roller rotatably fits when the idler roller shaft is placed in the first slot, wherein the lower reach of each upper belt is routed over the one idler roller for reverse order collation and wherein the lower reach of each upper belt is bypasses the upper ramp guide block for same order collation, the idler roller shaft being removable for routing the lower belt for same or reverse collation.

7 Claims, 6 Drawing Sheets

STANDARD AND REVERSE COLLATOR USING A REMOVABLE IDLER ROLLER SHAFT

BACKGROUND OF THE INVENTION

The present invention relates to a collating machine and more particularly to a collating machine having the dual capability of stacking sheets of paper in the same or reverse order in which they are fed to the collating machine.

Collating machines are frequently used in line with other paper handling equipment, such as inserting machines, as a means of assembling a plurality of sheets of paper into a particular, desired packet prior to further processing, which may include additional collating, folding and inserting. For further background, reference can be made to U.S. Pat. Nos. 3,935,429, 4,547,856 and U.S. Pat. No. 4,733,359. In a typical paper handling sequence involving an initial output consisting of a plurality of sheets of paper, which may later be combined with subsequent outputs from other sheet feeding devices situated downstream, the initial output is fed from a stack seriatim to the collator, which collates the output into the desired packets, either in the same order as the sheets had when they were in the stack upstream of the collator or in the reverse order. Each packet may then be folded, stitched or subsequently combined with other outputs from document feeding devices located downstream thereof and ultimately inserted into a mailing envelope.

In many cases it happens that the initial output to be collated arrives in an opposite order from that desired for downstream processing so that the collator needs to collate in an opposite manner to enable the documents to emerge from the collator in the proper sequence for subsequent handling. In such a case, one option is to have a second line of paper handling equipment which includes a collator having reverse collating capability. Clearly, this is not a desirable option to users of pape handling equipment. An improvement over the second line option is offered in U.S. Pat. No. 4,640,506, issued Feb. 3, 1987 to the assignee of the present application, which teaches the incorporation in the collating machine of removable reverse order stacking devices. It has been found that incorporating and removing machine parts requires time and effort which is very costly for complex equipment, such as an inserter, which can afford little down time. A further improvement over the removable devices, is disclosed in U.S. Pat. No. 4,805,891, issued Feb. 21, 1989 to the assignee of the present invention, which teaches a movable device in a collating machine, which can easily be moved by an operator from one position to another to change from standard sequence stacking to reverse sequence stacking. The movable device has worked well for collating in the reverse order, however problems have been experienced when switching from reverse to standard order collation. Additional adjustments requiring the use of tools by a service technician have been necessary to change from reverse to standard stacking of collations. Accordingly, the present invention provides an improvement to the movable reverse order collating device which improves the reliability of an operator changing the machine to collate from reverse to standard order.

SUMMARY OF THE INVENTION

In accordance with the foregoing, the present invention provides an improvement to a reversible collating machine for stacking sheets of paper fed seriatim thereto from a singulating feeder in the same or reverse order as the sheets appear in the singulating feeder. The collating machine comprises a plurality of upper and lower, endless, elastic belts suspended over a plurality of pulleys which are operatively connected to a plurality of shafts, each of the belts has an upper and lower reach wherein the lower reach of the upper belts and the upper reach of the lower belts frictionally engage and transport the sheets of paper, a frame slidably mounted to the housing, a plurality of upper and lower ramp guide blocks secured to a frame, which is movable between an upstream and a downstream position, and fixed stop means for stopping the leading edge of sheets being stacked, wherein each of the upper ramp guide blocks includes at least two idler rollers for defining a path for the upper belts, whereby when the frame is located in the upstream position collation in the same order is effected and when the frame is located in the downstream position collation in the reverse order is effected. The improvement comprises a removable idler roller shaft having rotatably mounted thereto one of the idler rollers for each of the upper ramp guide blocks, wherein each of the upper ramp guide blocks has a first slot in which the idler roller shaft rests and a second slot perpendicular to the first slot in which the one idler roller rotatably fits when the idler roller shaft is placed in the first slot, wherein the lower reach of each upper belt is routed over the one idler roller for reverse order collation and wherein the lower reach of each upper belt is bypasses the upper ramp guide block for same order collation, the idler roller shaft being removable for routing the lower belt for same or reverse collation.

BRIEF DESCRIPTION OF THE DRAWINGS

A complete understanding of the present invention maybe obtained from the following detailed description of the preferred embodiment thereof, when taken in conjunction with the accompanying drawings wherein like reference numerals designate similar elements in the various figures, and in which.

DESCRIPTION OF THE PREFERRED EMBODIMENT

Figure 1:
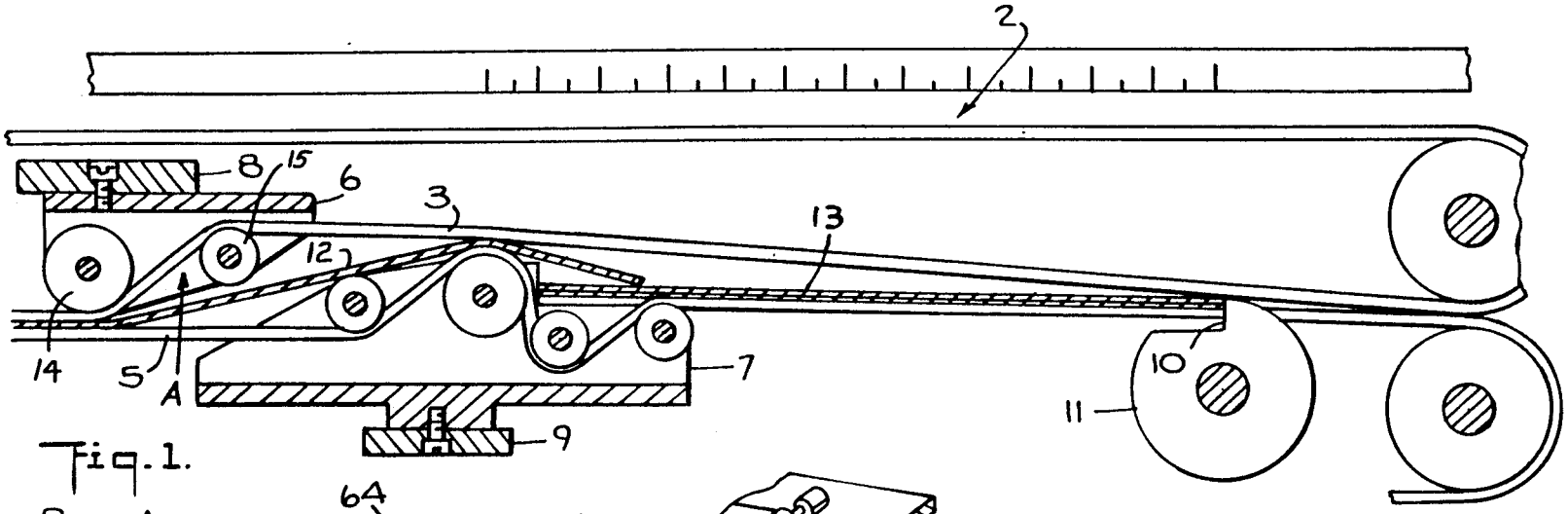
Fig. 1. PRIOR ART
FIG. 1 is a side elevational view of a prior art reversible collating machine.

Before describing the preferred embodiment of the present invention, reference is made to FIG. 1 wherein there is seen a prior art reversible collating machine, generally designated 2, disclosed in U.S. Pat. No. 4,805,891, incorporated herein by reference. The reversible collating machine 2 stacks sheets of paper 12 being fed seriatim thereto from a singulating feeder (not shown) in the same or reverse order as sheets 12 appear in the singulating feeder. The reversible collating machine 2 includes a plurality of endless, elastic belts, comprising at least one upper belt 3 and at least one lower belt 5 rotatably mounted to a mounting apparatus (not shown). Each of the belts includes an upper and a lower reach, the lower reach of the upper belt being situated slightly above the upper reach of the lower belt to thereby frictionally engage and transport sheets 12. The collating machine 2 further includes a frame (not shown) being movable within a housing between an upstream and downstream position in collating machine 2, an upper ramp guide block 6 secured to the frame, and a lower ramp guide block 7 secured to the frame. Lower block 7 has an L-shaped downstream portion, whereby when the frame is located in the upstream position a standard order of collation is effected and when the frame is located in the downstream position a reverse order is effected. In order to effect stacking of sheets 12 for a standard collation, i.e., in the same order as they appear in the supply stack at the singulating feeder, an upper mounting arm 8 is manually translated to a relatively upstream position, depending upon the length of sheets 12. Movement of arm 8 effects movement of upper ramp guide block 6, as well as lower ramp guide block 7, since upper block 6 is fixedly secured to arm 8 and lower block 7 is secured to lower mounting arm 9 which is connected to the upper mounting arm 8 by side brackets (not shown). Lower block 7 is situated so that there is sufficient room between a vertical face 10 of a registration disk 11 and a vertical abutment surface 12 of the block 7 to accommodate the sheets 12 being fully laid out in a substantially horizontal plane. The result of this spacing of lower block 7 with respect to registration disk 11 is that each succeeding sheet 12 is deposited on top of the preceding sheet 12, resulting in a stack 13 having sheets 12 therein appearing in the same order as in the supply stack, since sheets 12 are advanced one at a time from the bottom of the supply stack. Stack 13 comes to rest against vertical face 10 of the registration disk 11.

The problem experienced with reversible collating machine 2 is seen in the area designated A in FIG. 1. The lower reach of upper belt 3 is threaded along the path defined by idler rollers 14 and 15 included in upper guide block 6. The problem has been that the engagement of the belts 3 and 5 with sheet 12 captured between is not totally effective to ensure the proper functioning of collating machine 2 for standard collations. As shown in FIG. 1, there is limited engagement of the aforementioned belts with sheet 12. It has been found that the amount of engagement by belts 3 and 4 does not provide enough positive drive to carry sheet 12 forward to collation stack 13. Heretofore, technicians have resorted to trial and error mechanical adjustments so that collating machine 2 could be used in standard collation mode. However, no standard approach has heretofore been found to alleviate the problem, nor has an operator adjustable solution been found.

Figure 2:
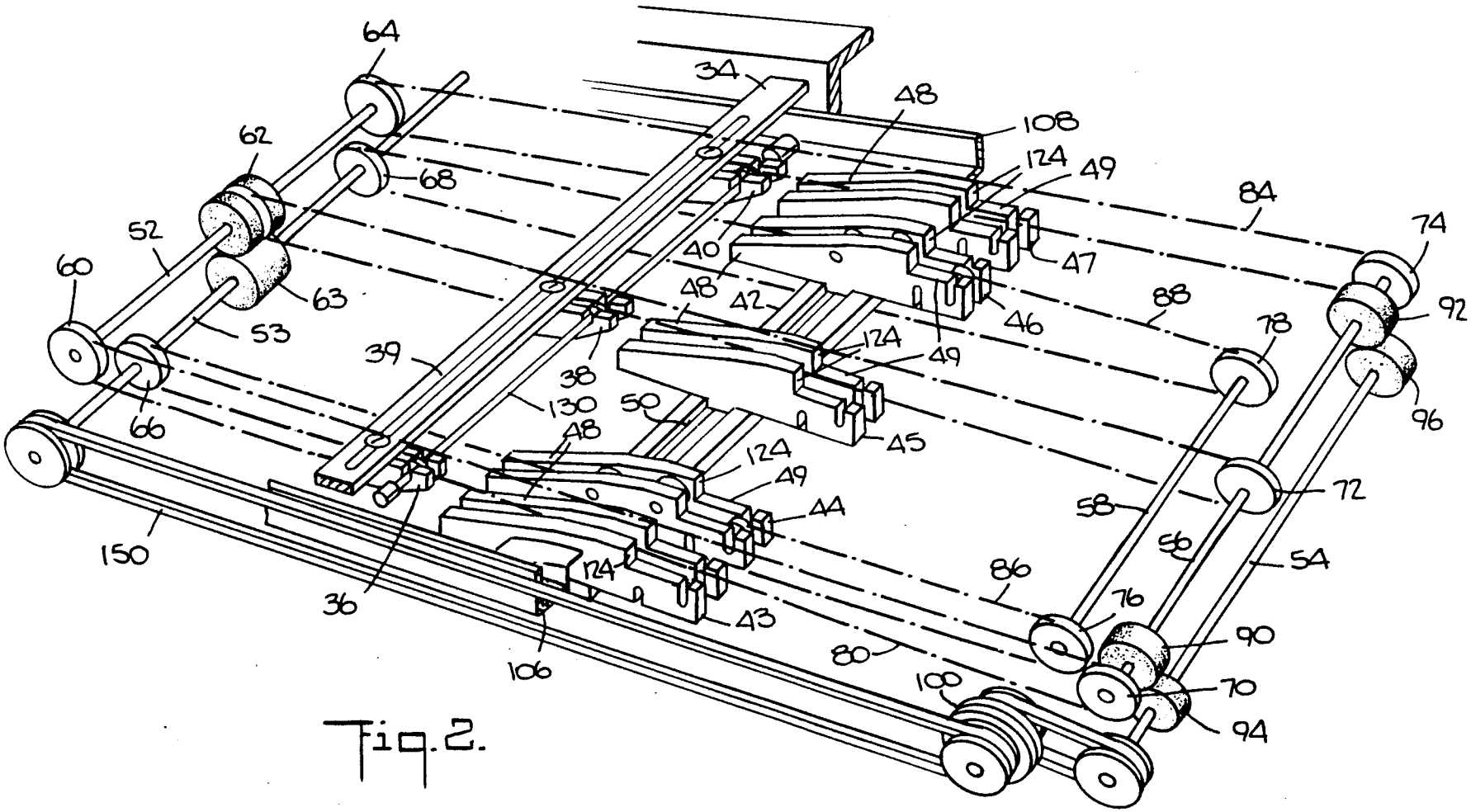
FIG. 2 is a perspective view of an in-line collating machine in accordance with the present invention.
Figure 3:
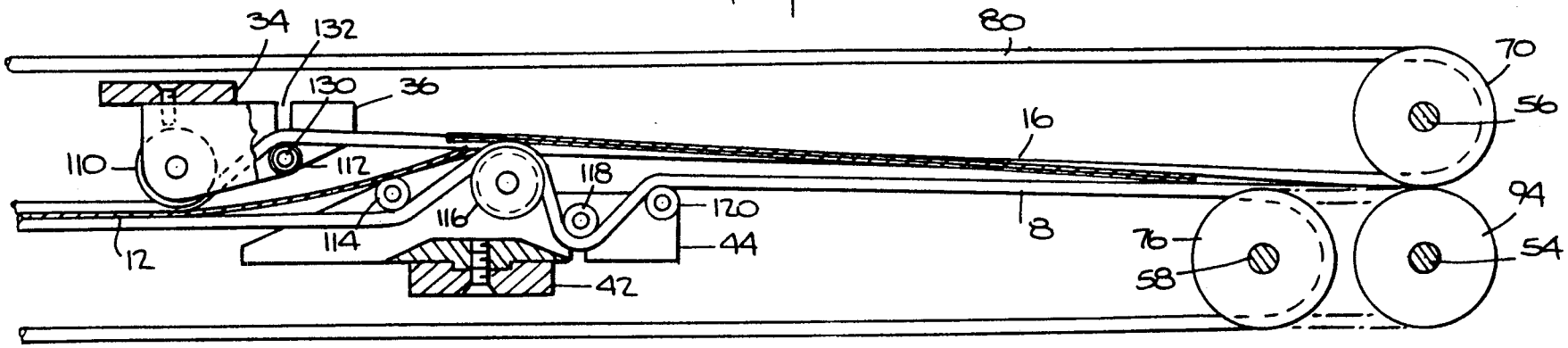
FIG. 3 is a vertical sectional view of the collating machine seen in FIG. 2 arranged to collate sheets in reverse order.
Figure 4:
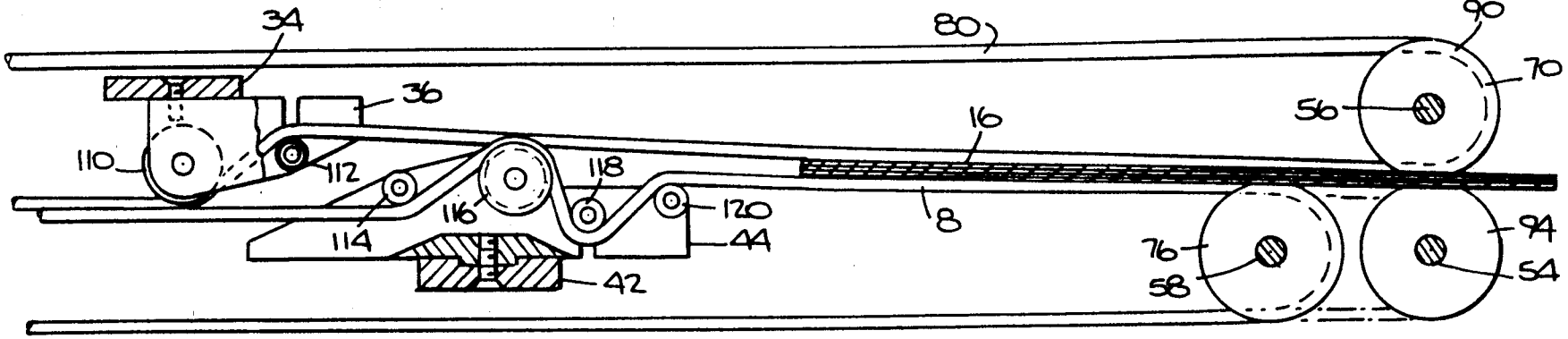
FIG. 4 is the same as FIG. 3 except that the collated sheets are being advanced downstream from the collating machine.
Figure 8:
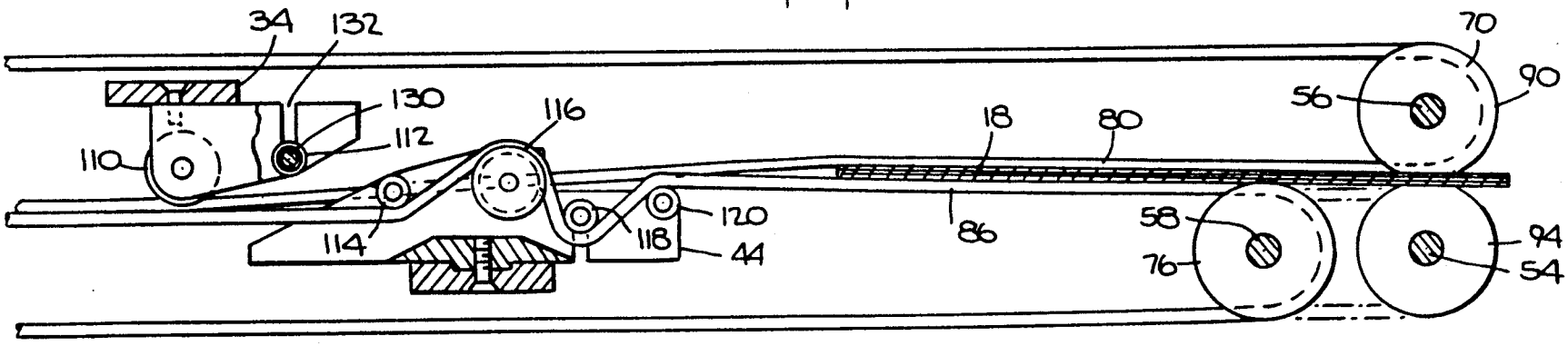
FIG. 8 is the same as FIG. 7 except that the collated sheets are being advanced downstream from the collating machine.
Figure 9:
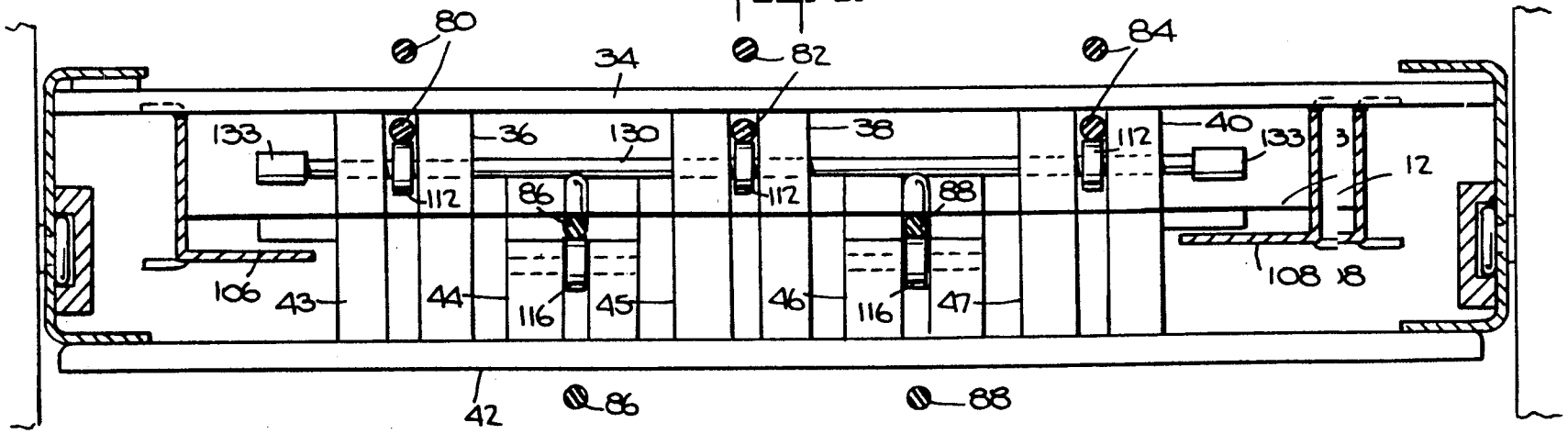
FIG. 9 is a front view taken along lines 5—5 in FIG. 2 showing a sheet being conveyed to the collation stack.
Figure 10:
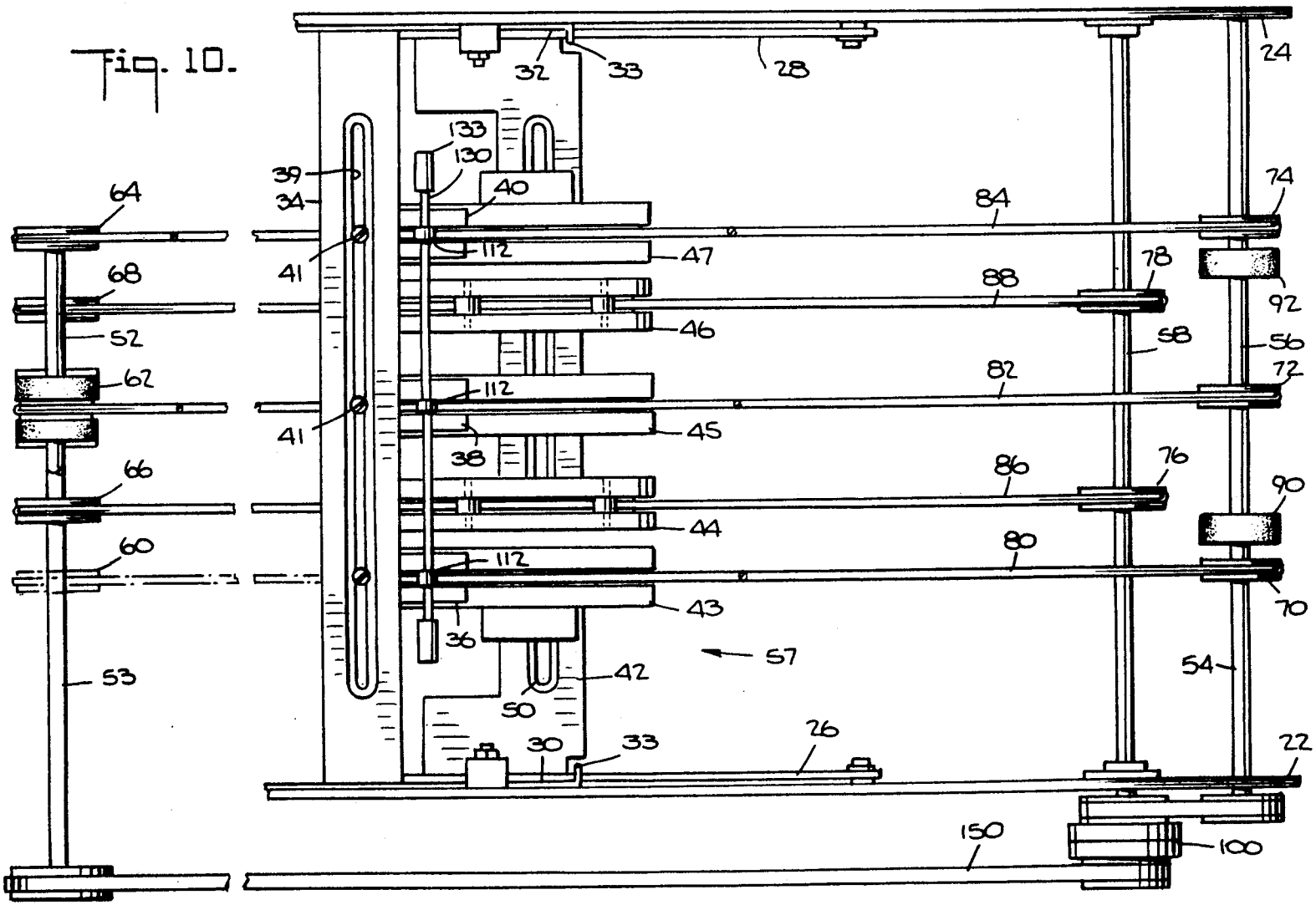
FIG. 10 is a top plan view of the collating machine seen in FIG. 2.

In describing the preferred embodiment of the present invention, reference is made to the drawings wherein there is seen in FIGS. 2 through 10 a collating machine, generally designated 20, for receiving individual sheets of paper 12 fed seriatim from an upstream singulating feeder (not shown), accumulating a collation of sheets and conveying the collation downstream, for example to a folding machine, for further processing. Collating machine 20 is capable of accumulating a plurality of sheets 12 in a standard order, i.e., the bottom sheet 12 in the supply stack at the singulating feeder would also be the bottom sheet in the accumulated stack 18 seen in FIGS. 7 and 8. Also, collating machine 20 is capable of accumulating a plurality of sheets 12 in reverse order as shown in FIGS. 3 and 4, i.e., the bottom sheet 12 in the supply stack would be the top sheet 12 in the accumulated stack 16. This is accomplished by means of suitable, cooperating, conveying apparatus within collating machine 20. As shown in FIG. 10, the conveying apparatus is situated between a pair of housing panels 22 and 24 and includes a pair of beams 26 and 28 secured to the panels 22 and 24 respectively. Slidably mounted on beams 26 and 28 respectively are a pair of brackets 30 and 32 between which an upper mounting arm 34 is transversely secured. Brackets 30 and 32 include flanges 33 which have apertures 35 therein for slidably receiving beams 26 and 28.

Figure 7:
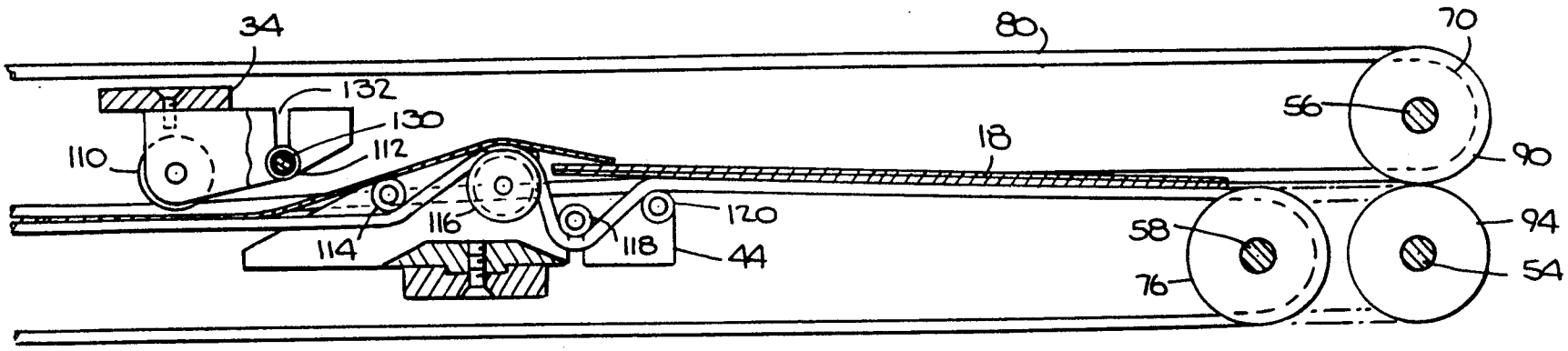
FIG. 7 is a vertical sectional view of the collating machine seen in FIG. 2 arranged to collate sheets in standard order.

Three upper ramp guide blocks 36, 38 and 40 are fixedly secured to mounting arm 34 by screws 41. Blocks 36, 38 and 40 are slidable transversely owing to screws 41 which are slidably mounted in a channel 39 which traverses the arm 34. Extending from the lower portions of brackets 30 and 32 transversely thereof is a lower mounting arm 42 on which five lower ramp guide blocks 43, 44, 45, 46 and 47 are mounted. Blocks 43 through 47 are slidable transversely owing to screws 48 which are slidably mounted in a channel 50 which traverses arm 42. Each of lower guide blocks 43 through 47 includes a lower inclined end 48 on the upstream side for intercepting a leading end of sheets 12 as they are individually conveyed through collating machine 20 after having been separated by the upstream singulating feeder (not shown). On the downstream side of each lower guide block 43 through 47 there is a flat surface 49 for accepting the upstream end of standard collation 18 as shown in FIG. 7. Arms 34 and 42 together with the brackets 30 and 2 comprise a slidable frame generally designated 57 (see FIG. 10).

As best seen in FIGS. 2 and 10, four driven shafts 52, 53, 54 and 56 and one idler shaft 58 are suitably journaled in the panels 22 and 24 or other support structure not shown. Shafts 53 and 54 are operatively connected to and driven by a conventional drive system 150. Rollers 62 and 63 are secured to shafts 52 and 53 respectively. Two pulleys 60 and 64 are secured to driven shaft 52, and two pulleys 66 and 68 are secured to driven shaft 53. Shaft 52 is driven by the friction drive of roller 63 against roller 62 which has a center slot whereby roller 62 operates as a center pulley on driven shaft 52. Three idler pulleys 70, 72 and 74 are operatively connected to the driven shaft 56 while two idler pulleys 76 and 78 are operatively connected to the idler shaft 58, whereby pulleys 70 through 78 are not secured to their respective shafts so that they freely rotate. A suitable, upper, endless, elastic conveyor belt 80 is suspended on pulleys 60 and 70, a second suitable, upper, endless, elastic conveyor belt 82 is suspended on pulleys 62 and 72, while a third suitable, upper, endless, elastic conveyor belt 84 is suspended on pulleys 64 and 74. Similarly, a suitable, lower, endless elastic conveyor belt 86 is suspended over pulleys 66 and 76 while a second, suitable, lower, endless, elastic conveyor belt 88 is suspended on pulleys 68 and 78.

There are a pair of stop rollers 90 and 92 which are secured to driven shaft 56, while two stop rollers 94 and 96 are secured to driven shaft 54. Shaft 54 is driven by convention drive system 150 when a clutch 100 is engaged. Shaft 58 in turn is driven by the friction drive of rollers 94 and 96 against rollers 90 and 92 respectively. Rollers 90 through 96 are situated on shafts 56 and 54 such that rollers 90 and 94 and rollers 92 and 96 operate cooperatively to stop the advancement of sheets when clutch 100 is not engaged, and to convey the stack of accumulated sheets when clutch 100 is engaged.

Figure 6:
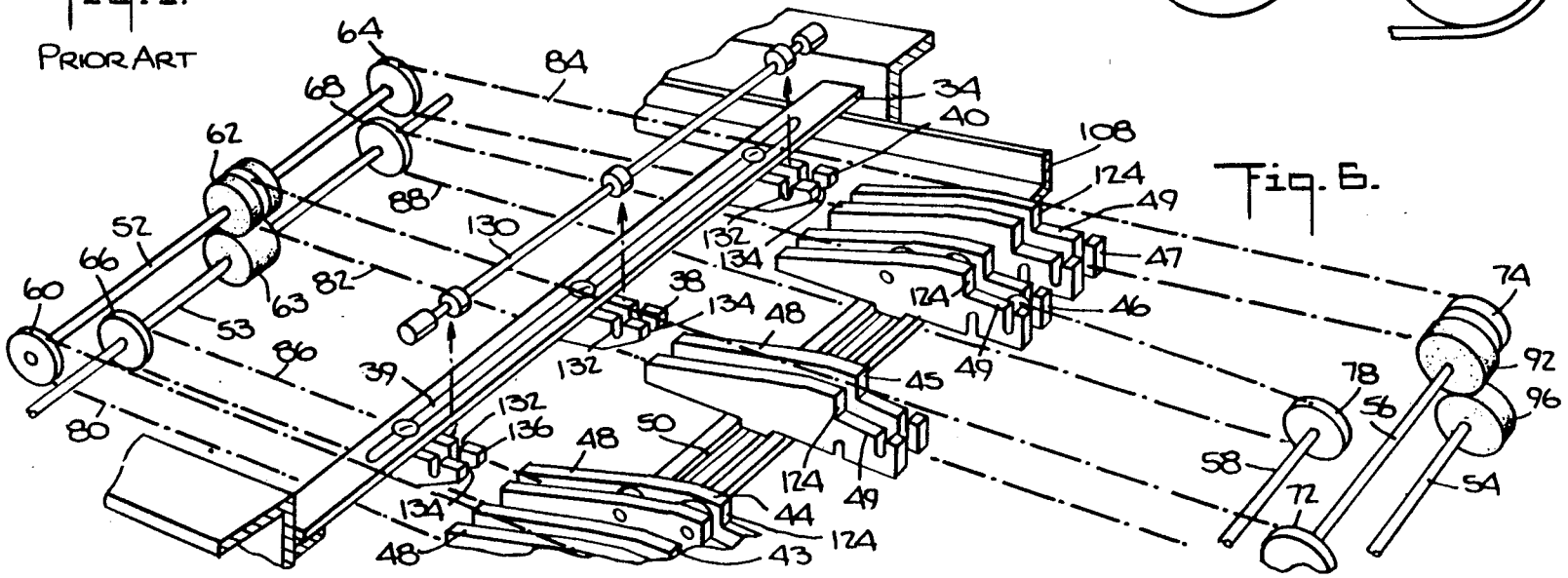
FIG. 6 is a sectional perspective view of the collating machine seen in FIG. 2 with a removable belt pulley shaft removed from the upper guide blocks.

A pair of paper guides 106 and 108 are secured to the panels 22 and 24 respectively for guiding sheets 12 through collating machine 20. For additional guidance of sheets 12, each of the upper guide blocks 36, 38 and 40 includes a suitably journaled idler roller 110 and each of lower guide blocks 44 and 46 includes four suitably journaled idler rollers 114, 116, 118 and 120, as best seen in FIGS. 3 through 9. There is an additional idler roller 112 for each of the upper guide blocks 36, 38 and 40. In accordance with the present invention, rollers 112 are operatively connected to a removable shaft 130. As best seen in FIGS. 2, 6 and 10, shaft 130 fits into a slot 132 in each of blocks 36, 38 and 40. Rollers 112 are slidable along shaft 130 for inserting the respective roller 112 into the longitudinal channel 134 in each of block 36, 38 and 40.

In the preferred embodiment of the present invention, lower guide blocks 43, 45 and 47 are included to add stability to the control of sheets 12 as they are ramped up to the collation area. Although blocks 43, 45 and 47 can be positioned so that the lower reach of upper belts 80, 82 and 84 pass through the longitudinal channel in the respective blocks, blocks 43, 45 and 47 do not include any idler rollers because they do not engage any of the belts.

Figure 5:
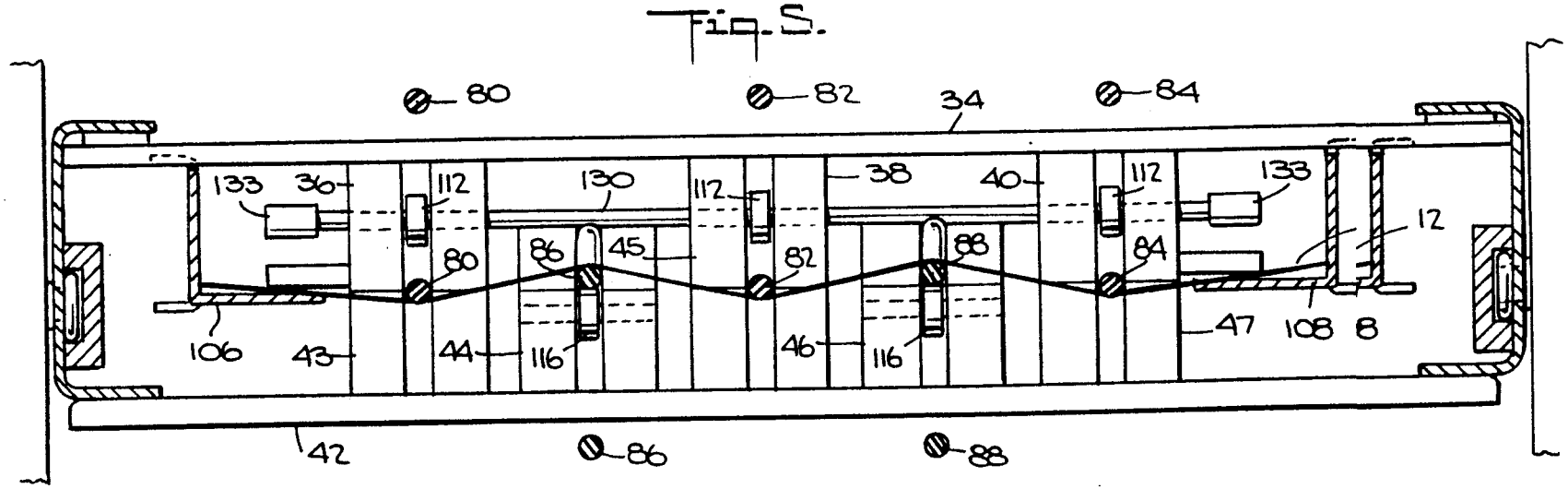
FIG. 5 is a front view taken along lines 5—5 in FIG. 2 showing a sheet being conveyed to the collation stack.

Idler rollers 110 and 112 provide and define the appropriate path for upper belts 80, 82 and 84 while the four idler rollers 114, 116, 118 and 120 provide and define the appropriate path for lower belts 86 and 88. When rollers 112 engage belts 80, 82, and 84, the lower reach of belts 80, 82 and 84 are maintained above the upper reach of belts 86 and 88, as best seen in FIG. 5. When rollers 112 are placed in blocks 36, 38 and 40 so as not to engage belts 80, 82 and 84, the lower reach of belts 80, 82 and 84 is situated at approximately the same vertical position of the upper reach of lower belts 86 and 88, as best seen in FIG. 9. It will be understood by those skilled in the art, that the latter configuration provides more positive control to convey sheet 12 over lower guide blocks 43 through 47 to form a collation stack.

The construction of the belts 80, 82, 84, 86 and 88 are of an "0" ring nature, but it is possible to utilize a flat belt, as long as the belt material is elastic, or there is provided an adequate belt tensioning system, the likes of which are well known by those skilled in the art.

Lower guide blocks 43 through 47 are seen to include an L-shaped downstream portion defined by horizontal support surfaces 49 and vertical abutment surfaces 124 (see FIG. 2). Rollers 116 and 118 are arranged that the conveyor belts 86 and 88 are maintained remote from the surfaces 112 and 124.

Having explained the details of the apparatus hereinabove, the two modes of operation will now be explained. In order to effect stacking of sheets 12 in the reverse order as they appear in the supply stack at the singulating feeder (not shown), upper mounting arm 34 is manually translated to a relatively downstream position, depending upon the length of sheets 12, as seen in FIGS. 3 and 4. As best seen in FIG. 5, removable shaft 130 is situated in blocks 36, 38 and 40 so that the respective idler rollers 112 engage the lower reach of belts 80, 82 and 84. If belts 80, 82 and 84 are not engaged by rollers 112, shaft 130 must be removed from slots 132 in blocks 36, 38 and 40 and then reinserted into slots 132 with the respective idler rollers 112 engaging the lower reach of belts 80, 82 and 84. Lower blocks 43 through 47 are situated so that the trailing end of each sheet 12 is elevated with respect to the leading end; i.e., the trailing end of sheets 12 is caused to rest across the top of blocks 43 through 47, which results in each succeeding sheet 12 being inserted beneath each preceding sheet 12 and effecting a stack 16 having sheets 12 therein appearing in the reverse order as in the supply stack at the singulating feeder, since sheets 12 are advanced one at a time from the bottom of the supply stack. As seen in FIG. 3, stack 16 comes to rest against roller pairs 90, 94 and 92, 96. Once the required number of sheets 12 has been accumulated in stack 16, clutch 100 is enabled and causes stack 16 to be advanced downstream, as seen in FIG. 4, for further processing.

In order to effect stacking of sheets 12 in the same order as they appear in the supply stack at the singulating feeder not shown), upper mounting arm 34 is manually translated to a relatively upstream position, depending upon the length of sheets 12, as seen in FIGS. 7 and 8. As best seen in FIG. 9, removable shaft 130 is situated in blocks 36, 38 and 40 so that the respective idler roller 112 does not engage the lower reach of belts 80, 82 and 84. This is accomplished by removing shaft 130 from slots 132 in blocks 36, 38 and 40, as shown in FIG. 6, and returning shaft 130 to slots 132 without the respective idler rollers 112 engaging the lower reaches of belts 80, 82 and 84. Movement of arm 34 effects movement of upper ramp guide blocks 36, 38 and 40, as well as lower ramp guide blocks 43 through 47, since upper blocks 36, 38 and 40 are fixedly secured to arm 34 and lower blocks 43 through 47 are secured to lower mounting arm 42 which is secured to brackets 30 and 32 which in turn are secured to upper mounting arm 34. Translation of arm 34 is possible because brackets 30 and 32 which are secured to arm 34 are slidably mounted on beams 26 and 28 respectively. As best seen in FIG. 6, lower blocks 43 through 47 are situated so that there is sufficient room between the nips of roller pairs 90, 94 and 92, 96 and the vertical abutment surfaces 124 of blocks 43 through 47 to accommodate the sheets 12 being fully laid out in a substantially horizontal plane. The result of this spacing of lower blocks 43 through 47 with respect to rollers 90, 92, 94 and 96 is that each succeeding sheet 12 is deposited on top of the preceding sheet 12, resulting in a stack 18 having sheets 12 therein appearing in the same order as in the supply stack in the singulating feeder, since sheets 12 are advanced one at a time from the bottom of the supply stack. Stack 18 comes to rest against the rollers 90, 92, 94 and 96, as shown in FIG. 7.

When collating machine 20 has accumulated the required number of sheets 12 in stack 18, a predetermined electronic control device (not shown) provides power to the electromagnetic clutch 100 which then rotatably engages shaft 54 having rollers 94 and 96 mounted coaxially therewith. Clutch 100 is rotatably coupled to drive member 150 and stack 18 is then advanced along a path downstream to, for example a folding machine or other appropriate apparatus, for subsequent operations.

It will be understood by those skilled in the art that alternative structure allowing the removal of idler rollers 112 may also be suitable for an easy adjustment between standard and reverse collation. For example, a separate shaft, sized to fit into slot 132 for each idler roller 112 can be used in place of one shaft 130.

From the foregoing description, it is clear that the present invention provides an improvement to a movable ramp guide block system which can be easily adjusted by the operator in order to effect standard order or reverse order collating from a stack of supply sheets. It will be appreciated by those skilled in the art that the reconfiguration of collating machine 20 can easily be handled by an operator and does not require the sensitive adjustments that have heretofore required reconfiguration by a service technician.

Therefore, having briefly described an embodiment of the present invention which enables a machine operator to convert a collating machine from a mode where sheets are collated in one order to an alternate mode where the sheets may be collated in a reverse order, it will be evident that changes to the machine described herein will only enhance the present invention which is captured in the spirit and scope of the following claims.

What is claimed is:

1. In a reversible collating machine for stacking sheets of paper fed seriatim thereto from a singulating feeder in the same or reverse order as said sheets appear in said singulating feeder, said collating machine comprising a plurality of upper and lower, endless, elastic belts suspended over a plurality of pulleys, said pulleys being operatively connected to a plurality of shafts, each of said belts having an upper and lower reach wherein the lower reach of the upper belts and the upper reach of the lower belts frictionally engage and transport said sheets of paper, an upper ramp guide block secured to a frame, and a lower ramp guide block secured to said frame, said frame being movable between an upstream and a downstream position, wherein said upper ramp guide block includes at least two idler rollers for defining a path for the upper belts, whereby when said frame is located in said upstream position collation in the same order is effected and when said frame is located in said downstream position collation in the reverse order is effected, an improvement comprising:

a removable idler roller shaft having rotatably mounted thereto one of the idler rollers for said upper ramp guide block, wherein said upper ramp guide block has a first slot in which said idler roller shaft rests and a second slot perpendicular to said first slot in which said one idler roller rotatably fits when said idler roller shaft is placed in said first slot, wherein the lower reach of one of said upper belts is routed over said one idler roller for reverse order collation and wherein the lower reach of said upper belt bypasses said upper ramp guide block for same order collation.

2. The improvement of claim 1 wherein said idler roller shaft is removable from said first slot for routing said lower reach of said upper belt from reverse to standard collation.

3. The improvement of claim 1 wherein said idler roller shaft is insertable into said first slot with said lower reach of at least one of said upper belts suspended over a respective one of said one idler rollers.

4. In a reversible collating machine for stacking sheets of paper fed seriatim thereto from a singulating feeder in the same or reverse order as said sheets appear in said singulating feeder, said collating machine comprising a plurality of upper and lower, endless, elastic belts suspended over a plurality of pulleys, said pulleys being operatively connected to a plurality of shafts, each of said belts having an upper and lower reach wherein the lower reach of the upper belts and the upper reach of the lower belts frictionally engage and transport said sheets of paper, a plurality of upper ramp guide blocks secured to a frame, and a plurality of lower ramp guide blocks secured to said frame, said frame being movable between an upstream and a downstream position, wherein each of said upper ramp guide blocks includes at least two idler rollers for defining a path for the upper belts, whereby when said frame is located in said upstream position collation in the same order is effected and when said frame is located in said downstream position collation in the reverse order is effected, an improvement comprising:

at least one removable idler roller shaft having rotatably mounted thereto one of the idler rollers, wherein each of said upper ramp guide blocks has a first slot in which said idler roller shaft can rest and a second slot perpendicular to said first slot in which said one idler roller rotatably fits when said idler roller shaft is placed in said first slot, wherein the lower reach of the upper belt is routed over said one idler roller for reverse order collation and wherein the lower reach of each upper belt bypasses said upper ramp guide block for same order collation.

5. The improvement of claim 4 wherein a separate removable idler shaft and said one idler roller rest in said first and second slots respectively in each of said upper ramp guide blocks.

6. The improvement of claim 4 wherein each of said idler roller shafts is removable from the respective one of said first slot for routing said lower reach of said upper belt from reverse to standard collation.

7. The improvement of claim 4 wherein each of said idler roller shafts are insertable into the respective one of said first slots with said lower reach of one of said upper belts suspended over a respective one of said one idler rollers.

* * * * *